US011004378B2

(12) United States Patent
Shi

(10) Patent No.: US 11,004,378 B2
(45) Date of Patent: May 11, 2021

(54) COLOR SHIFT CORRECTION FOR A DISPLAY PANEL

(71) Applicant: INTERNATIONAL BUSINESS MACHINES CORPORATION, Armonk, NY (US)

(72) Inventor: Wen Zhe Shi, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 206 days.

(21) Appl. No.: 16/017,293

(22) Filed: Jun. 25, 2018

(65) Prior Publication Data

US 2019/0392747 A1 Dec. 26, 2019

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2320/0666* (2013.01); *G09G 2360/16* (2013.01)

(58) Field of Classification Search
CPC ..... G09G 2320/048; G09G 2320/0242; G09G 3/3208; G09G 3/2003; G09G 2360/16; G09G 2320/0666
See application file for complete search history.

(56) References Cited

U.S. PATENT DOCUMENTS 6,552,735 B1 * 4/2003 Dehmlow ..... G09G 3/3208 345/204
9,111,485 B2 8/2015 Chaji et al.
9,578,719 B2 2/2017 Han et al.
2006/0092108 A1 * 5/2006 Ozaki ..... G09G 3/3208 345/76
2016/0379551 A1 * 12/2016 Zhuang ..... G09G 3/3208 345/520
2017/0287391 A1 * 10/2017 Zhuang ..... G06F 13/14
2018/0190174 A1 * 7/2018 Kambhatla ..... G09G 3/007
2019/0156746 A1 * 5/2019 Kim ..... G09G 3/3233

FOREIGN PATENT DOCUMENTS

CN 103745688 A 4/2014
CN 106157894 A 11/2016
CN 106157929 A 11/2016
JP 201397287 A 5/2013
WO 2016184282 A1 11/2016

OTHER PUBLICATIONS

Yang et al., "Self-Compensated Control Scheme for Improving Organic LED Luminance Uniformity in WSN", CSQRWC2013, pp. 396-399.

* cited by examiner

*Primary Examiner* — Patrick N Edouard
*Assistant Examiner* — Douglas M Wilson
(74) *Attorney, Agent, or Firm* — L. Jeffrey Kelly

(57) ABSTRACT

Method, display panel, computer program product, and color shift correction apparatus include correcting a color shift of a self-luminescent display panel in which a current brightness level of at least one monochromatic luminescent device is obtained and a brightness attenuation level of the at least one monochromatic luminescent device is calculated. The brightness of the at least one monochromatic luminescent device is then compensated based on the current brightness level and the brightness attenuation level. The calculation of the brightness attenuation level is based on a recorded accumulated working time, and a pre-configured attenuation rate function of the at least one monochromatic luminescent device.

18 Claims, 4 Drawing Sheets

COLOR SHIFT CORRECTION FOR A DISPLAY PANEL

BACKGROUND

The present invention relates to display technologies, and more specifically, to method, system and device for correcting a color shift of a self-luminescent display panel.

As display technology has advanced, consumer demands and expectations for more improved audio-visual products has also grown exponentially. As for display manufacturers, the production of displays with high resolution and high image quality is the developing direction. Self-luminescent display panels, e.g. Organic Light-Emitting Diode (OLED) display panels have been widely applied in displays due to the characteristics of self-luminescent, high brightness, wide viewing angle, rapid response, the capability of forming red, green and blue (RGB) full-color components, etc. Currently, the application of self-luminescent display panels has entered a booming stage. Automobile audios and mobile phones on the market have widely employed self-luminescent display panels and will be more and more widely applied in related consumer markets.

SUMMARY

In one illustrative embodiment of the present invention, there is provided a method for correcting a color shift of a self-luminescent display panel in which a current brightness level of at least one monochromatic luminescent device is obtained and a brightness attenuation level of the at least one monochromatic luminescent device is calculated. The brightness of the at least one monochromatic luminescent device is then compensated based on the current brightness level and the brightness attenuation level. The calculation of the brightness attenuation level is based on a recorded accumulated working time and a pre-configured attenuation rate function of the at least one monochromatic luminescent device.

In another illustrative embodiment of the present invention, there is further provided a self-luminescent display panel which comprises multiple monochromatic luminescent devices and a color shift correction module. The color shift correction module is configured to obtain a current brightness level of at least one monochromatic luminescent device and calculate a bright attenuation level of the at least one monochromatic device. The brightness of the at least one monochromatic device is compensated based on the current brightness level and the brightness attenuation level. The calculation of the brightness attenuation level is based on a recorded accumulated working time and a pre-configured attenuation rate function of the at least one monochromatic luminescent device.

In another illustrative embodiment of the present invention, there is provided a computer program product which comprises computer readable storage medium and program instructions stored thereon, the program instructions comprising program instructions to obtain a current brightness level of at least one monochromatic luminescent device, and program instructions to calculate a bright attenuation level of the at least one monochromatic device, and program instructions to compensate the brightness of the at least one monochromatic device based on the current brightness level and the brightness attenuation level. The calculation of the brightness attenuation level is based on a recorded accumulated working time and a pre-configured attenuation rate function of the at least one monochromatic luminescent device.

In still another illustrative embodiment of the present invention, there is provided a color shift correction apparatus which comprises computer readable storage medium and program instructions store thereon, the program instructions comprising program instructions to obtain a current brightness level of at least one monochromatic luminescent device, and program instructions to calculate a bright attenuation level of the at least one monochromatic device, and program instructions to compensate the brightness of the at least one monochromatic device based on the current brightness level and the brightness attenuation level. The calculation of the brightness attenuation level is based on a recorded accumulated working time and a pre-configured attenuation rate function of the at least one monochromatic luminescent device.

These and other features and advantages of the present invention will be described in, or will become apparent to those of ordinary skill in the art in view of, the following detailed description of the example embodiments of the present invention.

BRIEF DESCRIPTION OF THE DRAWINGS

Through the more detailed description of some embodiments of the present disclosure in the accompanying drawings, the above and other objects, features and advantages of the present disclosure will become more apparent, wherein the same reference generally refers to the same components in the embodiments of the present disclosure.

DETAILED DESCRIPTION

Some preferable embodiments will be described in more detail with reference to the accompanying drawings, in which the preferable embodiments of the present disclosure have been illustrated. However, the present disclosure can be implemented in various manners, and thus should not be construed to be limited to the embodiments disclosed herein.

Figure 1:
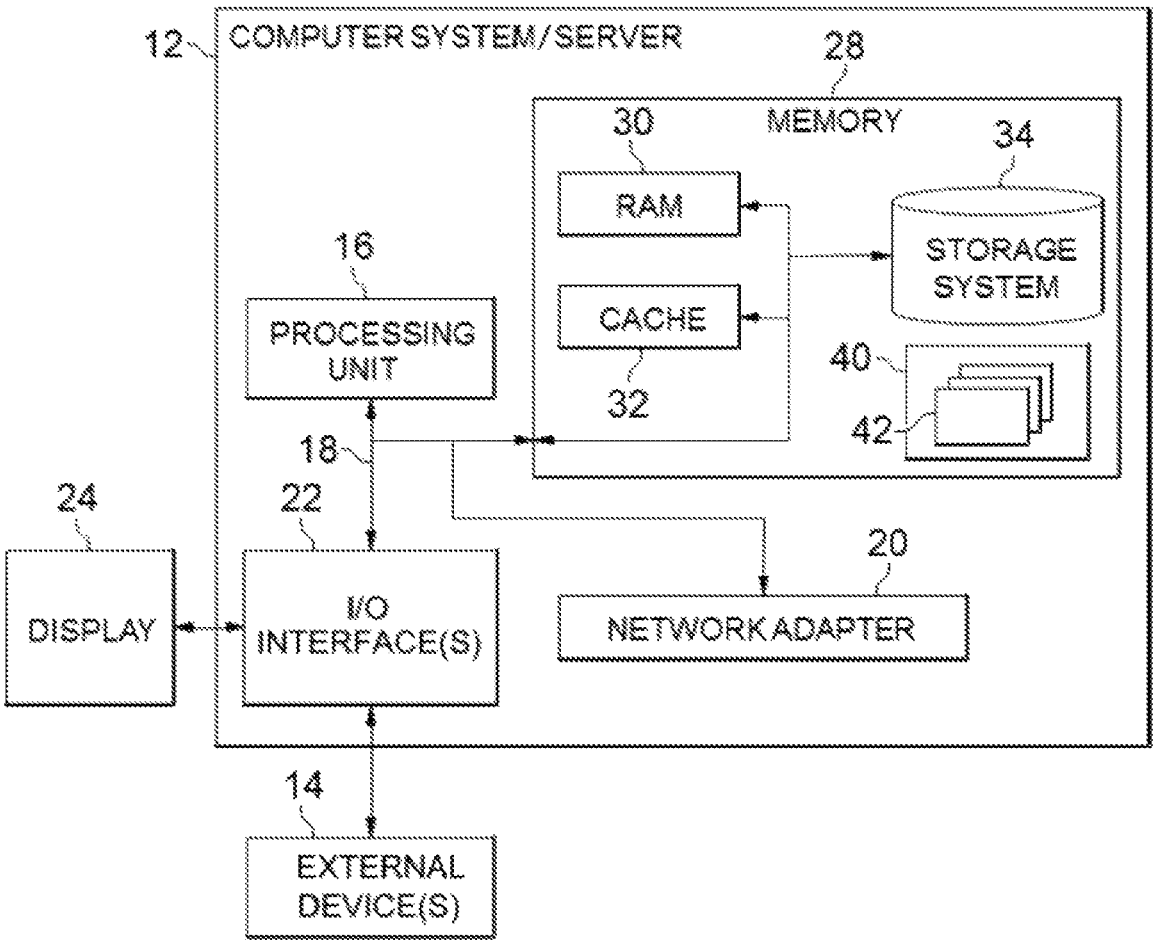
FIG. 1 is a block diagram depicting an exemplary computer system which is applicable to implement the embodiments of the present invention.

Referring now to FIG. 1, in which an exemplary computer system/server 12 which is applicable to implement the embodiments of the present invention is shown. FIG. 1 is also adapted to depict an illustrative example of a portable electronic device such as a communication device which is applicable to implement the embodiments of the present invention. Computer system/server 12 is only illustrative and is not intended to suggest any limitation as to the scope of use or functionality of embodiments of the invention described herein.

As shown in FIG. 1, computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

It should be pointed out that the exemplary computer system/server 12 which is applicable to implement embodiments of the present invention is described with reference to FIG. 1 in the above, however, any other existing or future developed systems, apparatuses, devices, etc. are also applicable to implement embodiments of the present invention, as long as they are equipped with self-luminescent display panels which utilize multiple different monochromatic luminescent devices.

Figure 2:
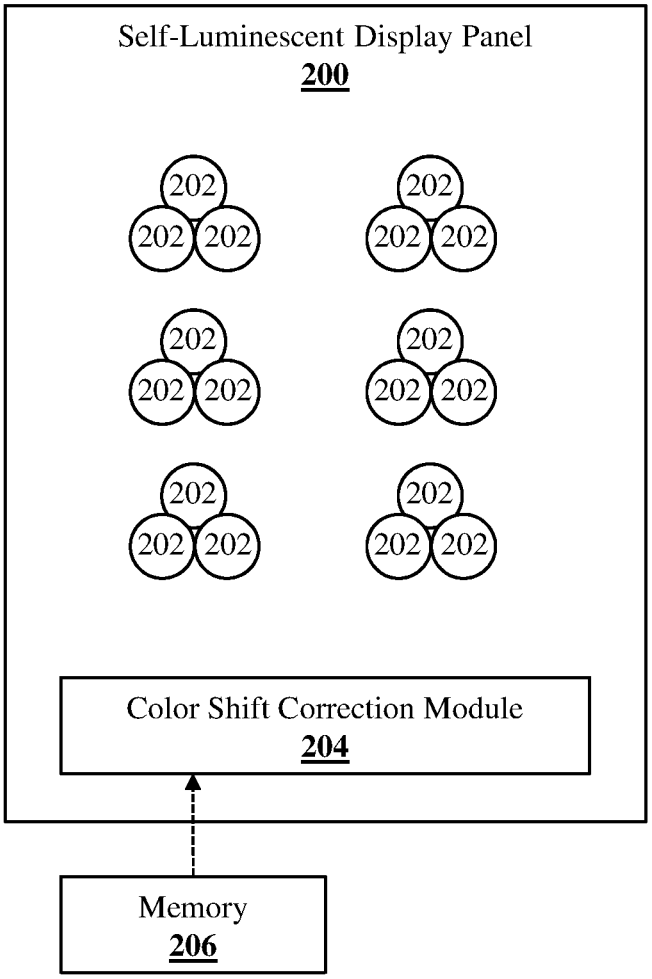
FIG. 2 shows an exemplary self-luminescent display panel 200 according to an embodiment of the present invention.

In the following, an embodiment of the invention will be discussed with reference to FIG. 2 which illustrates an exemplary self-luminescent display panel 200 comprising multiple monochromatic luminescent devices 202 according to an embodiment of the present invention. In FIG. 2, the multiple monochromatic luminescent devices 202 are shown in six groups with each group corresponding to a pixel of the self-luminescent display panel 200 and comprising three monochromatic luminescent devices 202 including a red, a green and a blue (RGB) color luminescent device 202. According to other embodiments of the present invention, each group may comprise other types of monochromatic luminescent devices 202 depending on the color configuration of the display panel 200, e.g. a group of four monochromatic luminescent devices 202 including a red, a green, a blue and a white (RGBW) color luminescent device 202, or a cyan, magenta, yellow and key (black) (CMYK) color luminescent device 202. According to an embodiment of the present invention, the self-luminescent display panel 200 is OLED display panel, however it should be clear to a person skilled in the art that embodiments of the invention are not limited to the above-mentioned color configurations or OLED display panels, rather any other types of color configurations or self-luminescent display panels. The self-luminescent display panel 200 may be part of the display 24 of FIG. 1. Also, FIG. 2 is merely for illustrative purpose and is not in proportion.

FIG. 2 shows an exemplary self-luminescent display panel 200. According to an embodiment of the present invention, the self-luminescent display panel 200 comprises a color correction module 204 which is configured to correct a color shift of the self-luminescent display panel 200. In the following, the functionality of the color correction module 204 will be described in detail with reference to the process it implements to correct the color shift of the display panel 200 shown in FIG. 3, which illustrates a method 300 for correcting a color shift of a self-luminescent display panel 200 (e.g. the self-luminescent display panel 200 of FIG. 2) according to an embodiment of the present invention. The color correction module 204 may be implemented for example as one of the program modules 42 that may be part of the computer system 12 or be implemented as part of the display 24 of FIG. 1.

Figure 3:
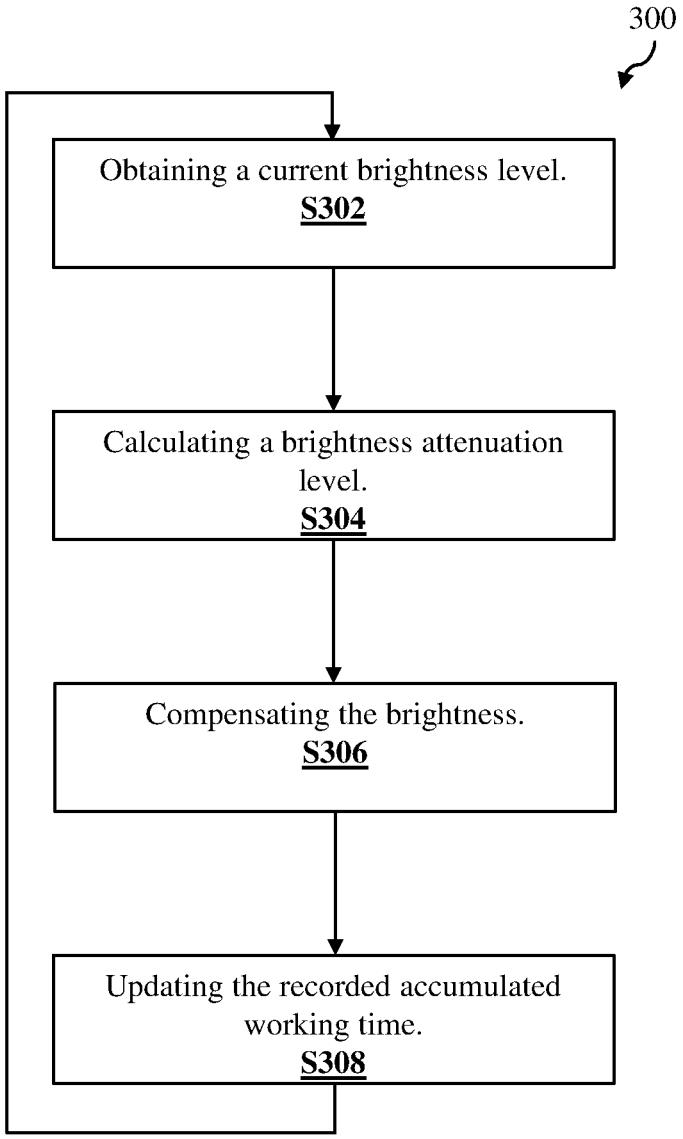
FIG. 3 shows a flowchart of an exemplary method 300 according to another embodiment of the present invention.

Now referring to FIG. 3. In step S302, a current brightness level of at least one monochromatic luminescent device 202 of a self-luminescent display panel 200 is obtained. Typically, a self-luminescent display panel 200 comprises one or more groups of monochromatic luminescent devices 202, with each group comprising a plurality of monochromatic luminescent devices 202, as discussed above. According to an embodiment of the present invention, brightness level is an integer value which ranges from 0 to 255 with 0 as the lowest brightness level and 255 as the highest. By reading the brightness level of the pixel to which the at least one monochromatic luminescent device 202 belongs from the driver of the self-luminescent display panel 200, the current brightness level of the at least one monochromatic luminescent device 202 could be easily obtained. Other than above-mentioned approaches, the obtain of the brightness level of a monochromatic luminescent device 202 may also adopt any other approaches existed in the art or developed in the future. Also, it should be pointed out that although the brightness level is described here as an integer value ranging from 0 to 255 in the above, other embodiments of the present invention could also adopt any other suitable brightness level configurations.

Then in step S304, a brightness attenuation level of the at least one monochromatic luminescent device 202 is calculated. According to an embodiment of the present invention, the calculation of the brightness attenuation level of the at least one monochromatic luminescent device 202 is based on a recorded accumulated working time and a pre-configured attenuation rate function of the at least one monochromatic luminescent device 202. As different types of monochromatic luminescent devices 202 typically have different attenuation features, a respective attenuation rate function is pre-configured for each type of the monochromatic luminescent devices 202 (e.g. R/G/B color monochromatic luminescent device) with each attenuation rate function being determined by manufactures of the respective monochromatic luminescent device 202 at its production phase, according to an embodiment of the present invention. As the brightness of a monochromatic luminescent device 202 is attenuated with its time continuously, the attenuation rate function could be generally described as the following:

$$B_r = f(t) \tag{1}$$

in which $B_r$ represents the brightness attenuation level of the monochromatic luminescent device 202 in question, and t is the accumulated working time of it. In order to reduce the costs for calculating the brightness attenuation level of a monochromatic luminescent device 202, its attenuation rate function could be simplified to a piecewise-defined function according to an embodiment of the present invention, described as the following:

$$B_r = \begin{cases} B_1, & 0 \le t < t_1 \\ B_2, & t_1 \le t < t_2 \\ B_3, & t_2 \le t < t_3 \\ \dots \end{cases} \tag{2}$$

in which $B_r$ represents the brightness attenuation level of the monochromatic luminescent device 202 in question, and t is the accumulated working time of it. It should be pointed the functions discussed above are merely for the purpose of illustration, thus should not adversely limit the scope of the invention. A person skilled in the art would develop any other suitable types of functions as the attenuation rate function without departing the spirit of the present invention.

According to an embodiment of the present invention, the accumulated working time of a monochromatic luminescent device 202 is recorded for example in the memory 206 shown in FIG. 2. Although it is shown in FIG. 2 that the memory 206 is not part of the self-luminescent display panel 200, it could alternatively be part of the self-luminescent display panel 200, for example integrated with the color correction module 204. According to an embodiment of the present invention, the recorded accumulated working time of the at least one monochromatic luminescent device 202 is increased with each refresh of the at least one monochromatic luminescent device 202. According to another embodiment of the present invention, the recorded accumulated working time is increased by millisecond. In one embodiment, the accumulated working time may be recorded as real duration. In another embodiment, a counter could be used to record the accumulated working time and increased by one each millisecond, or each time the self-luminescent display panel 200 refreshes at the highest refreshing rate. In this case, if the self-luminescent display panel 200 works in different refresh rates at different time, the recorded accumulated working time of the at least one monochromatic luminescent device 202 is increased with each refresh of the highest refreshing rate. In certain embodiments, if the self-luminescent display panel 200 works in a different refreshing rate, the counter could be increased by the quotient of the highest refreshing rate divided by the working refreshing rate where the quotient is a natural number. For example, if the self-luminescent display panel 200 works at 60 Hz and the highest refreshing rate is 120 Hz, the counter could be increased by the quotient of the highest refreshing rate divided by the working refreshing rate, i.e., 120/60=2, each time when the self-luminescent display panel 200 refreshes. With the accumulated working time t and attenuation rate function (e.g. function (1) or function (2)), the brightness attenuation level of a monochromatic luminescent device 202 could be calculated.

According to an embodiment of the present invention, the color correction module 204 simply receives the brightness attenuation level of the at least one monochromatic luminescent device 202 calculated by the driver of the self-luminescent display panel 200, or any other processing unit the self-luminescent display panel 200 is coupled to.

With the current brightness level of the at least one monochromatic luminescent device 202 obtained, and the brightness attenuation level calculated, the method 300 proceeds to step S306 in which the brightness of the at least one monochromatic luminescent device 202 is compensated. For example, the current brightness level of the at least one monochromatic luminescent device 202 is 225, and its brightness attenuation level is 2, it will be compensated by increasing its brightness level with the brightness attenuation level, i.e., from 225 to 227. The compensation of the brightness of the at least one monochromatic luminescent device 202 could be easily done by increasing the voltage or current in the driver for direct current (DC) brightness control or the pulse width for pulse width modulation (PWM) brightness control. The compensation of brightness of a monochromatic luminescent device 202 may adopt any approaches known in the field and will not be discussed in detail.

After the compensation of the at least one monochromatic luminescent device 202 in step S306, the method 300 proceeds to step S308 in which the recorded accumulated working time is updated. The update of the recorded working time may use the counter according to the approaches as described above. Then the method 300 proceeds back to step S302.

In the above, embodiments of the present invention are described with reference to FIG. 3. In the following, further embodiments of the present invention will be described with reference to FIG. 4, which depicts a method 400 for correcting a color shift of a self-luminescent display panel 200 according to an embodiment of the present invention.

Figure 4:
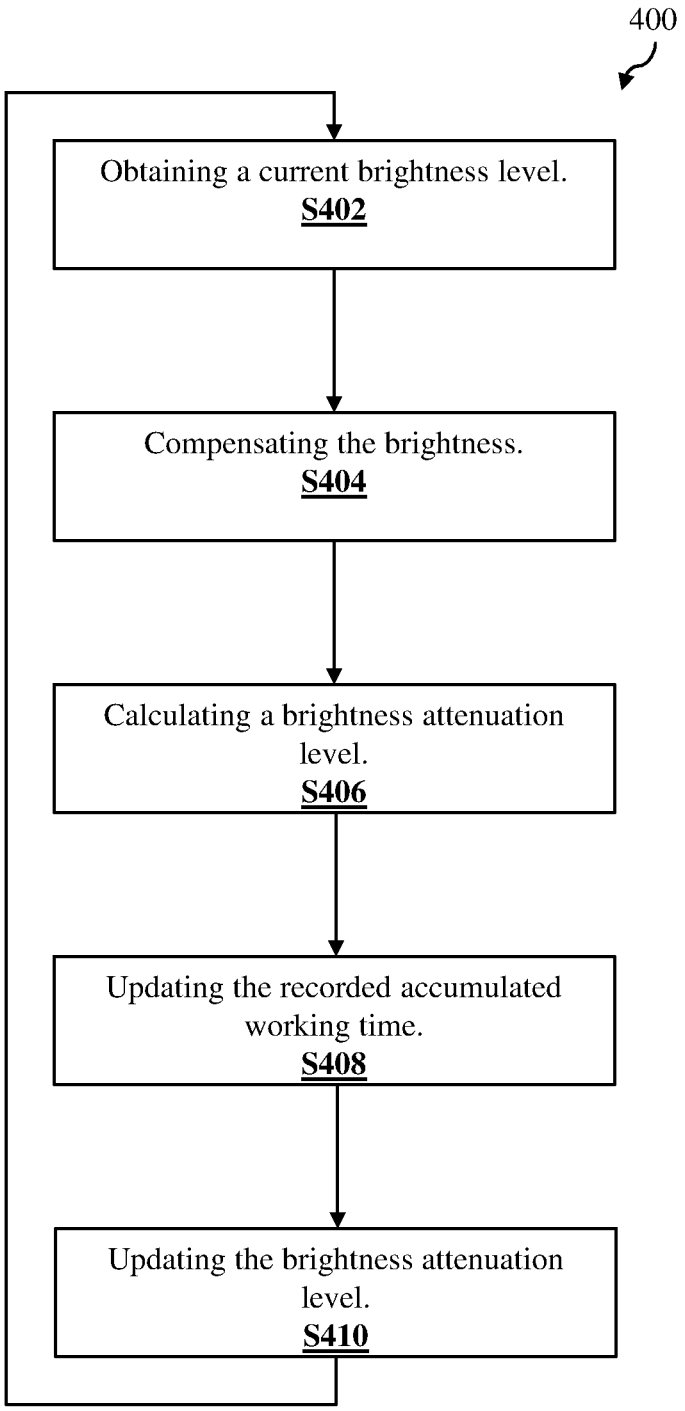
FIG. 4 depicts a flowchart of an exemplary method 400 according to another embodiment of the present invention.

Referring now to FIG. 4, different from the method 300 in FIG. 3, the compensation of at least one monochromatic luminescent device 202 is carried out in step S404 based on the current brightness level obtained in step S402 and a historical brightness attenuation level retrieved from the memory 206, prior to the calculation of the brightness attenuation level of the at least one monochromatic luminescent device 202. By pro-actively compensating the brightness, the efficiency of the color shift correction of the self-luminescent display panel 200 could be further improved. Then in step S406, the brightness attenuation level of the at least one monochromatic luminescent device 202 is calculated with the accumulated working time recorded and the pre-configured attenuation rate function, for example function (1) or (2) discussed above. Then the accumulated working time of the at least one monochromatic luminescent device 202 recorded is updated in step S408, and the historical brightness attenuation level of the at least one monochromatic luminescent device 202 is updated in step S410. Then the method 400 proceeds back to step S402.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for correcting a color shift of a self-luminescent display panel, comprising:

obtaining, by one or more processing units, a current brightness level of at least one monochromatic luminescent device;

calculating, by one or more processing units, a brightness attenuation level of the at least one monochromatic luminescent device, wherein the calculation of the brightness attenuation level is based on a recorded accumulated working time and a pre-configured attenuation rate function of the at least one monochromatic luminescent device, wherein the pre-configured attenuation rate function is a piecewise-defined function; and compensating, by one or more processing units, the brightness of the at least one monochromatic luminescent device based on the current brightness level and the brightness attenuation level.

2. The method of claim 1, wherein the recorded accumulated working time is increased with each refresh of the monochromatic luminescent device.

3. The method of claim 1, wherein the recorded accumulated working time is increased by a millisecond.

4. The method of claim 1, further comprising:

updating, by one or more processing units, the recorded accumulated working time of the at least one monochromatic luminescent device after the compensation of its brightness.

5. The method of claim 1, wherein the compensation of the brightness of the at least one monochromatic luminescent device is carried out prior to the calculation of the brightness attenuation level and is based on the current brightness level and a historical brightness attenuation level retrieved from a memory.

6. The method of claim 5, further comprising:

increasing, by one or more processing units, the recorded accumulated working time of the at least one monochromatic luminescent device; and updating, by one or more processing units, the historical brightness attenuation level of the at least one monochromatic luminescent device in the memory with the calculated brightness attenuation level.

7. A self-luminescent display panel, comprising:

multiple monochromatic luminescent devices;

a color shift correction module configured to:

obtain a current brightness level of at least one monochromatic luminescent device;

calculate a brightness attenuation level of the at least one monochromatic luminescent device, wherein the calculation of the brightness attenuation level is based on a recorded accumulated working time and a pre-configured attenuation rate function of the at least one monochromatic luminescent device, wherein the pre-configured attenuation rate function is a piecewise-defined function;

compensate the brightness of the at least one monochromatic luminescent device based on the current brightness level and the brightness attenuation level.

8. The self-luminescent display panel of claim 7, wherein the recorded accumulated working time is increased with each refresh of the monochromatic luminescent device.

9. The self-luminescent display panel of claim 7, wherein the recorded accumulated working time is increased by a millisecond.

10. The self-luminescent display panel of claim 7, wherein the color shift correction module is configured to:

update the recorded accumulated working time of the at least one monochromatic luminescent device after the compensation of its brightness.

11. The self-luminescent display panel of claim 7, wherein the compensation of the brightness of the at least one monochromatic luminescent device is carried out prior to the calculation of the brightness attenuation level and is based on the current brightness level and a historical brightness attenuation level retrieved from a memory.

12. The self-luminescent display panel of claim 11, wherein the color shift correction module is configured to:

increase the recorded accumulated working time of the at least one monochromatic luminescent device; and update the historical brightness attenuation level of the at least one monochromatic luminescent device in the memory with the calculated brightness attenuation level.

13. A computer program product for correcting a color shift of a self-luminescent display panel comprising:

a computer readable storage medium having program instructions embodied therewith, wherein the computer readable storage medium is not a transitory signal per se, the program instructions executable by a computer to cause the computer to perform a method, comprising:

obtaining a current brightness level of at least one monochromatic luminescent device;

calculating a brightness attenuation level of the at least one monochromatic luminescent device, wherein the calculation of the brightness attenuation level is based on a recorded accumulated working time and a pre-configured attenuation rate function of the at least one monochromatic luminescent device, wherein the pre-configured attenuation rate function is a piecewise-defined function;

compensating the brightness of the at least one monochromatic luminescent device based on the current brightness level and the brightness attenuation level.

14. The computer program product of claim 13, wherein the recorded accumulated working time is increased with each refresh of the monochromatic luminescent device.

15. The computer program product of claim 13, wherein the recorded accumulated working time is increased by a millisecond.

16. The computer program product of claim 13, wherein the program instructions stored on the computer storage readable medium further cause the computer to perform a method, further comprising:

updating the recorded accumulated working time of the at least one monochromatic luminescent device after the compensation of its brightness.

17. The computer program product of claim 13, wherein the compensation of the brightness of the at least one monochromatic luminescent device is carried out prior to the calculation of the brightness attenuation level and is based on the current brightness level and a historical brightness attenuation level retrieved from a memory.

18. The color computer program product of claim 17, wherein the program instructions stored on the computer readable storage medium further cause the computer to perform a method, further comprising:

increasing the recorded accumulated working time of the at least one monochromatic luminescent device; and updating the historical brightness attenuation level of the at least one monochromatic luminescent device in the memory with the calculated brightness attenuation level.

* * * * *